US007240668B1

(12) United States Patent
DeMinco

(10) Patent No.: US 7,240,668 B1
(45) Date of Patent: Jul. 10, 2007

(54) FUEL LEAK DETECTION APPARATUS AND METHOD

(75) Inventor: Chris M. DeMinco, Honeoye Falls, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/488,333

(22) Filed: Jul. 18, 2006

(51) Int. Cl.
*F02M 37/04* (2006.01)
*F02M 37/06* (2006.01)

(52) U.S. Cl. ..... 123/495; 123/446

(58) Field of Classification Search ..... 123/690, 123/495, 446; 277/310, 311, 343, 382, 434, 277/446; 73/118.1, 117.3, 116, 117.2, 49.7
See application file for complete search history.

(56) References Cited

U.S. PATENT DOCUMENTS

| | | | | |
|---|---|---|---|---|
| 3,039,780 | A * | 6/1962 | Nordell | 277/540 |
| 6,449,940 | B2 * | 9/2002 | Nagel | 60/39.63 |
| 6,860,255 | B2 * | 3/2005 | Yamaguchi et al. | 123/495 |
| 2005/0039525 | A1 * | 2/2005 | Wakahara et al. | 73/118.1 |
| 2005/0287016 | A1 * | 12/2005 | Knauth et al. | 417/273 |

* cited by examiner

*Primary Examiner*—Mahmoud Gimie
(74) *Attorney, Agent, or Firm*—Paul L. Marshall

(57) ABSTRACT

Apparatus and method for detecting a fuel leak from a component includes providing a fuel leak enclosure about the component being monitored.

31 Claims, 1 Drawing Sheet

FUEL LEAK DETECTION APPARATUS AND METHOD

TECHNICAL FIELD

The present invention relates to fuel leak detection for fuel containing devices. In one particularly advantageous embodiment, the invention relates to an apparatus and method for detecting a fuel leak in a fuel pump of the fuel system of a vehicle.

BACKGROUND OF THE INVENTION

Fuel systems for driving machinery or engines include various components such as a fuel tank, fuel lines for delivering the fuel to the engine, fuel pumps for pumping the fuel from the tank through the fuel lines to the engine, and fuel injectors for injecting fuel into a respective cylinder, for example. Fuel leaks (both liquid and vapor) may occur in any part of the fuel system and it is desirable to be alerted to such leaks at the earliest possible moment. Furthermore, due to environmental concerns and engine operating efficiency, it is desirable to prevent passage of leaked fuel into the atmosphere or into or onto surrounding components.

For example, one potential source of a fuel leak is at the mechanical rotary or reciprocating pump seal of a high pressure fuel pump in a vehicle fuel system. Direct injected gasoline engines require fuel pressures as high as 20 MPa to operate. The fuel pressure is normally generated by a mechanical engine-driven fuel pump. This high pressure fuel pump can be either directly mounted to the engine and driven from a dedicated cam lobe on the camshaft or a coupling driven from the end of the crankshaft, or remotely mounted and driven by the engine serpentine or a dedicated belt coming off the engine.

SUMMARY OF THE INVENTION

The present invention addresses the above need by providing a unique fuel leak detection system. In a broad aspect of the invention, a fuel leak enclosure is provided adjacent the component that is being monitored for a fuel leak. The component being monitored may be any component that comes into contact with fuel. In a vehicle, such components may include the fuel tank, fuel lines, fuel rails, fuel pumps and fuel injectors, for example.

The fuel leak enclosure is operable to capture the leaked fuel and substantially prevent the fuel from releasing to the atmosphere or surrounding components. In one embodiment of the invention, an outlet port is provided in the enclosure which directs any fuel leaked into the enclosure to a fuel monitoring system which is operable to detect the leaked fuel. If fuel is detected from the enclosure, further fuel control measures may be taken as desired such as an adjustment to the fuel delivery rate. In yet a further embodiment, the fuel diagnostic system may be used to identify the source of the leaked fuel. In yet another alternate embodiment of the invention, a fuel detector is positioned in proximity to the fuel leak enclosure and provides a signal if fuel is detected in the enclosure so that remedial measures may be taken.

In one exemplary application of the invention, the system detects fuel leaking from the piston or crank bearing seal of the fuel chamber of a fuel pump for a direct injection engine. In a preferred embodiment, a leak detection enclosure is provided externally of the pump's fuel chamber drive seal. The leak detection enclosure includes an outlet port that connects to a manifold vacuum source or the intake side of the PVC. Should the pump fuel chamber drive seal begin to fail, fuel will leak past the seal from the fuel chamber and into the leak detection enclosure, pass through the outlet port and enter the engine manifold. The air/fuel diagnostic system would detect an unexpectedly higher level of fuel and could be programmed to generate a diagnostic check or warning signal to the driver. For example, if an unexpected fuel level is detected, the diagnostic system can trigger a check engine or service engine code so that remedial measures may be initiated as soon as possible and preferably prior to complete seal failure.

In an alternate embodiment, fuel leak detection is provided by a hydrocarbon detector positioned in proximity to the leak detection chamber. Different fuel detectors may be used to detect the type of fuel being used in a particular application. For example, an alcohol detector may be used to detect an ethanol leak, and a hydrogen detector may be used to detect a hydrogen leak.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
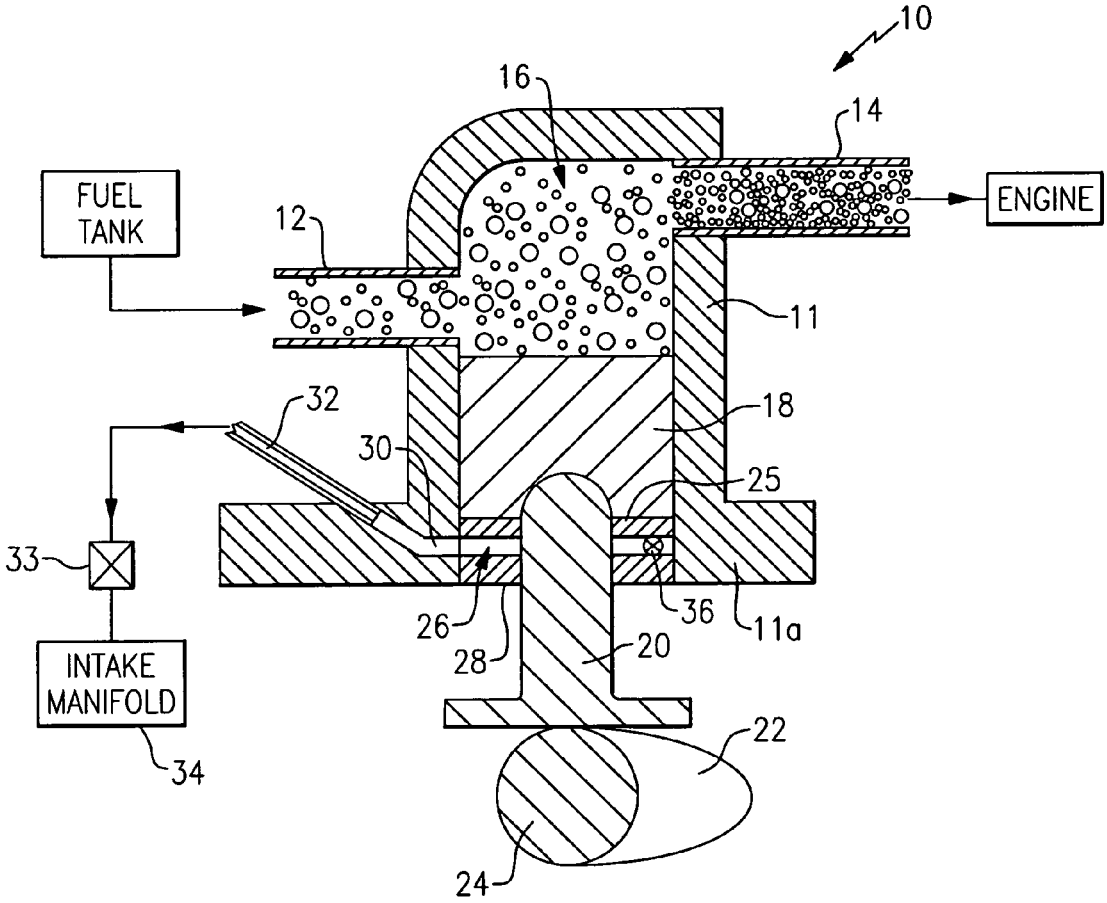
FIG. 1 is a cross sectional schematic of an embodiment of the invention.

Referring to FIG. 1, there is seen a schematic representation of an exemplary embodiment of the invention incorporated into a fuel pump 10 having a pump body 11, a low pressure fuel inlet 12 and a high pressure fuel outlet 14 for connecting to a fuel rail having fuel injectors for delivering fuel under pressure to the engine (fuel rail, injectors and engine are not shown). Fuel pump body 11 defines a fuel pump chamber 16 into which fuel is delivered from the fuel tank via inlet 12. A reciprocating piston 18 compresses the fuel during the advance stroke to deliver fuel under high pressure to the fuel rail via fuel outlet 14. Piston rod 20 may be driven by lobe 22 of cam shaft 24 although other mounting locations and drive means for operating fuel pump 10 may be used as dictated by the particular engine design being employed (e.g., a rotary driven pump or remotely mounted cambox system). It is therefore understood that this embodiment of the invention is not limited to the reciprocating pump design illustrated in FIG. 1.

As known in the art, fuel pump 10 is fit with a "wet" seal ring 25 to prevent fuel from leaking out of fuel pump chamber 16 between the interfacing surfaces of piston 18 (including rod 20) and pump body 11. According to a preferred embodiment of the invention, a fuel leak enclosure 26 is provided on the side of piston 18 opposite fuel chamber 16. A second "dry" seal ring 28 is provided adjacent the base 11*a* of pump body 11 such that leak detection enclosure 26 is defined by first seal ring 25, pump body 11, rod 20 and second seal ring 28. It will be appreciated that as rod 20 reciprocates, both first seal ring 25 and second seal ring 28 remain stationary with respect to the pump body 11. An outlet port 30 extends from leak detection 26 through pump body 11 for connecting to a line 32 ultimately leading to the engine induction system. Should fuel leak from pump chamber 16 into leak detection enclosure 26, the leaked fuel will be drawn into the engine by the manifold vacuum. Thus, the leaked fuel combines with the air/fuel mixture entering the engine. This of course increases the amount of fuel in the air/fuel mixture and this is detected by the vehicle's fuel monitoring system.

Present day vehicle closed loop fuel systems monitor the fuel delivery rate and can make real time adjustments to the rate of fuel delivery to maintain proper fuel control and emissions. As is well known to those skilled in the art, such closed loop fuel systems measure the oxygen level at the exhaust manifold to determine if the rate of fuel delivery is producing a combustion exhaust that is rich or lean. Based on the detected oxygen level and engine operating condition, the rate of fuel delivery may be increased or decreased to achieve the optimum air/fuel ratio input. A block learn multiplier ("BLM") may also be employed to calculate correction factors and make necessary adjustments to the fuel delivery rate to help keep the air/fuel ratio at the most efficient operating level.

Thus, with line 32 leading to the closed loop fuel system, any leaked fuel traveling through line 32 is sensed as an unexpectedly high fuel level by the fuel monitoring system which responds with the proper fuel delivery adjustment.

In a further, optional embodiment of the invention, a diagnostic component such as a solenoid 33, for example, may be positioned along line 32 to indicate whether or not the pump 10 is the source of the unexpected high fuel level. If the fuel monitoring system detects a higher than normal fuel level, the solenoid 33 may be activated to close line 32. If the fuel level drops back to expected ranges, then a leaking pump 10 is identified as the source of the unexpectedly high fuel level. If no change in fuel level is detected by the monitoring system when the solenoid is activated, the pump 10 may be ruled out as the source of the high fuel level and other sources may then be investigated.

In an alternate embodiment, a hydrocarbon or other fuel detector 36 is positioned inside or in close proximity to fuel leak enclosure 26. In this embodiment, an outlet port 30 and line 32 are not required. Hydrocarbon detector 36 may connect to the fuel monitoring system to provide a signal when a predetermined threshold of hydrocarbons (or other fuel molecules or atoms) are detected in enclosure 26.

It will thus be appreciated that the present inventive fuel leak detection system allows for detection of a fuel leak at the earliest possible moment. Since the leaked fuel is captured in the leak detection enclosure 26, leaked fuel is not released to the atmosphere or surrounding components. Early alert of the leak allows for quick remedial measures to be taken and thereby hopefully avoiding a total seal and pump failure.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A fuel pump comprising:

a) a fuel pump body having a fuel pump chamber, a fuel inlet port, and a fuel outlet port;

b) a piston having a piston rod for connecting to a piston drive operable to reciprocate said piston within said fuel pump chamber and thereby pump fuel from said fuel pump chamber through said fuel outlet port;

c) a first seal ring positioned at the interfacing surfaces of said piston and said fuel pump body; and d) a fuel leak enclosure located on the side of said piston opposite said fuel pump chamber, said fuel leak enclosure including a fuel outlet port leading the leaked fuel to a fuel monitoring system whereby leakage of fuel past said first seal ring passes fuel into said fuel leak enclosure and exits at said fuel outlet port of said fuel leak enclosure for detection by the fuel monitoring system.

2. The fuel pump of claim 1 wherein said fuel leak enclosure is defined by said first seal ring, said fuel pump body and said piston rod.

3. The fuel pump of claim 2 wherein said fuel leak enclosure is further defined by a second seal ring connected to said fuel pump body and wherethrough said piston rod extends.

4. The fuel pump of claim 1 wherein said fuel outlet port of said fuel leak enclosure leads to an engine air intake manifold.

5. The fuel pump of claim 1, wherein said fuel pump is incorporated into a fuel system of an engine powered vehicle and wherein said fuel monitoring system includes an oxygen detector for determining an air/fuel ratio at an exhaust of the engine.

6. A method of detecting a fuel leak in a component, said method comprising the steps of:

a) providing an enclosure positioned to capture fuel leaking from said component such that substantially no leaked fuel is released to the atmosphere; and b) providing an outlet in said enclosure wherethrough said leaked fuel may exit said enclosure and travel to a detector for detecting the presence of fuel in said enclosure.

7. The method of claim 6 wherein said detector is part of a closed loop fuel monitoring system.

8. The method of claim 7 wherein said detector is an oxygen detector for detecting an air/fuel ratio at an exhaust of an engine.

9. The method of claim 6 further comprising the step of providing a fuel detector in said enclosure.

10. The method of claim 9 wherein said fuel detector is operable to detect hydrocarbons.

11. The method of claim 9 wherein said fuel detector is operable to detect alcohol.

12. The method of claim 9 wherein said fuel detector is operable to detect hydrogen.

13. The method of claim 6 wherein said component is a fuel pump.

14. The method of claim 13 wherein said pump is installed in a vehicle and further comprising the step of generating a signal to a driver of the vehicle upon detecting fuel in said enclosure.

15. The method of claim 13 wherein said fuel pump is a high pressure fuel pump for a direct injection engine.

16. The method of claim 6 wherein said leaked fuel is drawn into an engine by a manifold vacuum.

17. The method of claim 16 wherein said leaked fuel combines with the an air/fuel mixture entering said engine, and wherein an increase in the amount of fuel in said air/fuel mixture is detected.

18. The method of claim 6 further comprising the step of providing a line extending from said outlet and leading to a closed loop fuel system, and providing a diagnostic component positioned along said line to determine if the component is the source of said leaked fuel.

19. The method of claim 18 wherein said diagnostic component closes said line if a fuel monitoring system detects a higher than normal fuel level.

20. The method of claim 19 wherein the component is identified as the source of said leaked fuel if said fuel monitoring system detects that said fuel level drops back to normal.

21. The method of claim 19 wherein said diagnostic component opens said line if said fuel monitoring system detects that said fuel level remains at said higher than normal fuel level.

22. The method of claim 18 wherein said diagnostic component includes a solenoid.

23. A fuel pump comprising:

a) a fuel pump body having a fuel pump chamber;

b) a piston connected to a piston drive operable to reciprocate said piston within said fuel pump chamber;

c) a first seal coupled with said fuel pump body so that said piston is sealed within said fuel pump chamber; and d) a fuel leak enclosure located on the side of said piston opposite said fuel pump chamber, said fuel leak enclosure including a fuel outlet port leading the leaked fuel to a fuel monitoring system, whereby leakage of fuel past said first seal passes fuel into said fuel leak enclosure and exits at said fuel outlet port of said fuel leak enclosure for detection by the fuel monitoring system.

24. The fuel pump of claim 23 wherein said fuel leak enclosure is defined by said first seal and said fuel pump body.

25. The fuel pump of claim 24 wherein said fuel leak enclosure is further defined by a second seal coupled to said fuel pump body.

26. The fuel pump of claim 23 wherein said fuel outlet port of said fuel leak enclosure leads to an engine air intake manifold.

27. The fuel pump of claim 23, wherein said fuel pump is incorporated into a fuel system of an engine powered vehicle and wherein said fuel monitoring system includes an oxygen detector for determining an air/fuel ratio at an exhaust of the engine.

28. The fuel pump of claim 23, wherein said piston has a piston rod for connecting to said piston drive, said piston rod extending through said first seal.

29. A fuel pump included in a fuel system for an engine, the engine including an engine intake manifold, the fuel pump comprising:

a) a fuel pump chamber;

b) a fuel leak enclosure including an outlet port for directing leaked fuel to the engine intake manifold;

c) a first seal disposed between said fuel pump chamber and said fuel leak enclosure; and d) a fuel monitoring system configured for detecting leaked fuel from said outlet port that combines with an air/fuel mixture located in the engine intake manifold.

30. The fuel pump of claim 29, wherein a pressure differential draws leaked fuel through said outlet port in said fuel leak enclosure and into the engine intake manifold.

31. The fuel pump of claim 29, wherein said fuel leak enclosure is defined by said first seal and a second seal.

* * * * *